US011800912B2

(12) United States Patent
Caswell

(10) Patent No.: US 11,800,912 B2
(45) Date of Patent: Oct. 31, 2023

(54) ROTARY ADJUSTABLE WATCH BAND

(71) Applicant: Crayton Caswell, North Kansas City, MO (US)

(72) Inventor: Crayton Caswell, North Kansas City, MO (US)

( * ) Notice: Subject to any disclaimer, the term of this patent is extended or adjusted under 35 U.S.C. 154(b) by 0 days.

(21) Appl. No.: 17/116,009

(22) Filed: Dec. 9, 2020

(65) Prior Publication Data

US 2022/0175097 A1 Jun. 9, 2022

(51) Int. Cl.
*A44C 5/20* (2006.01)
*A44C 5/18* (2006.01)

(52) U.S. Cl.
CPC ..... *A44C 5/185* (2013.01); *A44C 5/2019* (2013.01)

(58) Field of Classification Search
CPC ..... Y10T 24/45089; Y10T 24/45094; Y10T 24/4523; Y10T 24/45969; Y10T 24/4736; Y10T 24/4755; Y10T 24/4782; Y10T 24/47; A44C 5/185; A44C 5/2019; A44C 5/0023; A44C 5/20; A44C 5/2071; A44C 5/246; A44C 5/2023; A44C 5/2057; A44B 11/008; A44B 11/006; A44B 11/223; A44B 11/24; G04B 37/14; G04B 37/0008; G04B 37/18; F16G 11/12; F16G 11/14; F16G 11/143
USPC ..... 224/175, 176; 368/282; 292/25–27, 292/36–37, 64, 256.5, 257; 2/321, 322; 24/DIG. 47
See application file for complete search history.

(56) References Cited

U.S. PATENT DOCUMENTS 1,817,475 A * 8/1931 Becker ..... A44C 5/22 63/3
3,848,912 A * 11/1974 Jensen ..... E05C 5/00 292/259 R
4,365,832 A * 12/1982 Treppler ..... B63B 19/24 292/259 R
6,256,798 B1 * 7/2001 Egolf ..... A42B 3/08 2/421
9,551,405 B1 * 1/2017 Chen ..... A41D 13/0556
10,463,120 B2 * 11/2019 De Iuliis ..... A44C 5/246

* cited by examiner

*Primary Examiner* — Jack W Lavinder
(74) *Attorney, Agent, or Firm* — Arthur K. Shaffer; McDowell, Rice, Smith & Buchanan, PC

(57) ABSTRACT

The present invention provides a rotary adjustable watch band comprising a rectangular housing with a rotary gear extending therethrough, a tab extends upwardly from the housing, a fastener extending down from the housing and the fastener being in communication with the rotary gear whereby rotation of the rotary gear incrementally spaces the fastener from the housing.

7 Claims, 4 Drawing Sheets

ROTARY ADJUSTABLE WATCH BAND

FIELD OF THE INVENTION

The current invention relates in general to an improved wrist band for use with a personal management device, and more specifically to an improved rotary adjustable watch band with a rotary adjuster and at least one push button release mechanism.

BACKGROUND OF THE INVENTION

Personal management devices, such as watches, fitness trackers, schedulers, communication devices have become once again popular as people go about their busy lifestyles. in many cases, the bands are worn continuously for days at the gym, the beach, the office and at school in a variety of ambient conditions and surrounding temperatures.

Most wrist bands are worn on the wrist or forearm of a wearer, the specific dimension of which vary from a variety of factors from about 5 inches to 11 inches in diameter in increments of ¼ an inch. In addition, the personal preference of how tight or loose a wearer will wear their wrist band will vary. Because these personal management devices are designed to be worn in a variety of activities and environments, the wrist band needs to be constantly adjusted. For example, as the user moves between sedentary and more active activities their body changes and their dimension of their wrist band may need to expand or contract. Therefore, there is a need for an accurately, easily adjustable wrist band which allows a user to quickly, accurately and easily adjust their wrist band.

Typical wrist bands are either fixed or adjustable. Adjustable bands are typically adjusted using ¼" increments with, for example, a single prong buckle fastener. However, these fasteners can pinch or pull the wearer's skin or hair. Fixed wrist bands are typically either elastic bands or segmented bands. The elastic bands can stretch, but are generally loose and not very useful when used with a personal management device. Segmented bands are typically adjusted with the use of specialty tools for removing excess segments to provide a band which is generally fixed. Typically, the adjusted segmented bands are configured to compress the wearer's wrist which can cause discomfort or can result in pinching of the wearer's skin and hair. The discomfort and hair pulling can increase while the wearer is engaging in active activities. Therefore, there is a need for a adjustable wrist band which will decrease the discomfort and pinching of the wearer's Therefore, there is a need for a rotary adjustable wrist band which at least partially addresses some of the aforementioned disadvantages.

SUMMARY OF THE INVENTION

In an embodiment of the present invention, the foregoing is addressed by providing a rotary adjustable watch band comprising a rectangular housing with a rotary gear extending therethrough, a tab extending upwardly from said housing, a fastener extending downwardly from said housing; and said fastener being in communication with said rotary gear whereby rotation of said rotary gear incrementally spaces said fastener from said housing.

In general, the rotary adjustable watch band is configured for receipt of a strap connectably secured to a rotary closure which includes the detachable tab at one end and the fastener at the other, the fastener being adjustable by rotation of the gear.

DETAILED DESCRIPTION

Certain terminology will be used in the following description for convenience in reference only and will not be limiting. For example, top, bottom, front, back, right and left refer to the illustrated embodiment as oriented in the view being referred to. The words "upwardly" and "downwardly" refer to directions up or down and away from, respectively, the geometric center of the embodiment being described and designated parts thereof. Such terminology will include the words specifically mentioned, derivatives thereof and words of similar meaning.

Figure 1:
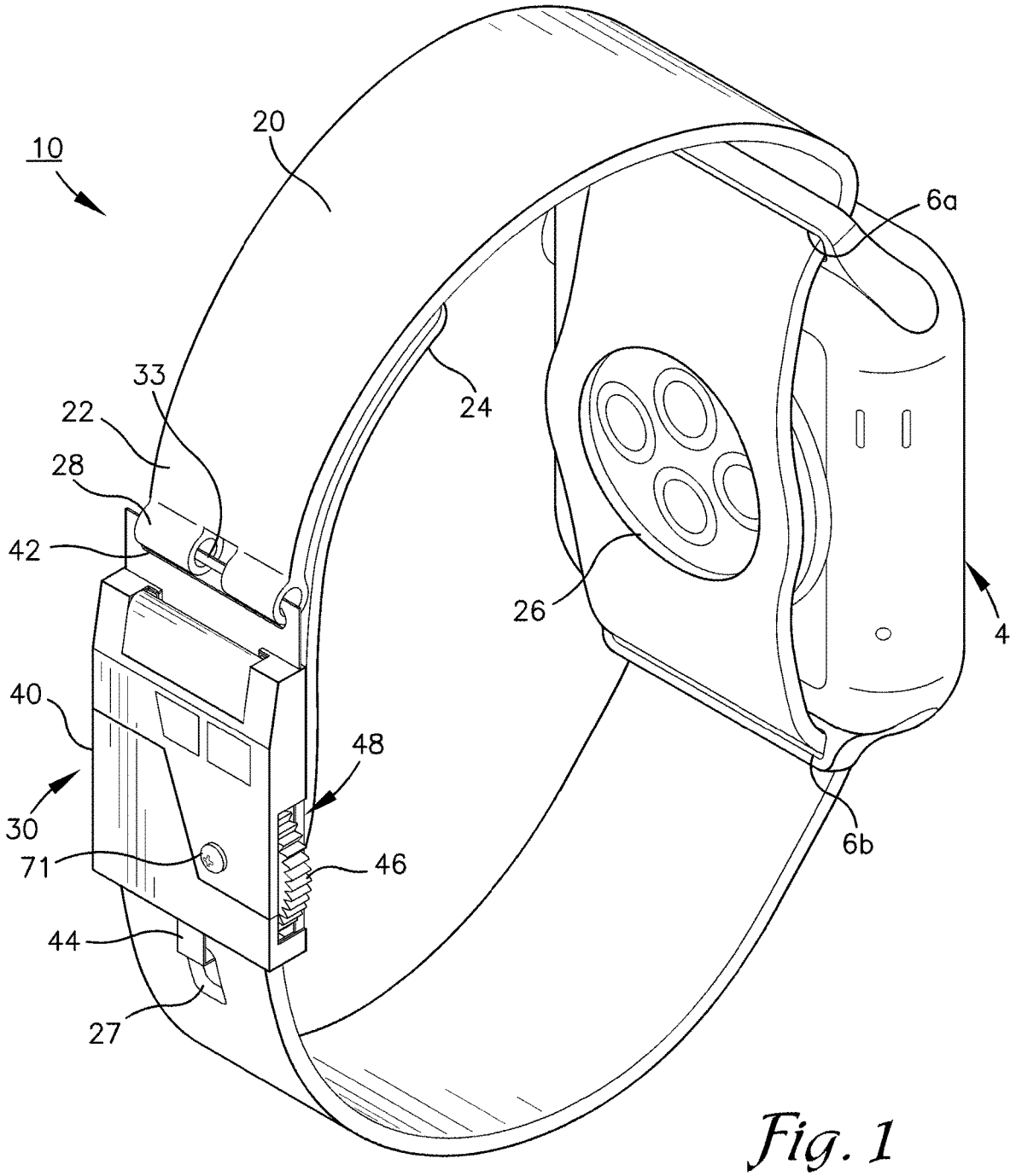
FIG. 1 is a rear perspective view of the rotary adjustable wrist band in receipt of a personal management device in accordance with one embodiment of the present invention.

Referring to FIG. 1, a personal management device 4 is illustrated attached to the rotary adjustable wrist band generally referred to by reference numeral 10. The personal management device can include a number of electronic and mechanical devices, including a watch, a fitness device, a GPS device, a tracking device, a messaging device, a camera, a phone, a biometric device, a personal digital reader, an RFID device among other devices used for managing or monitoring different aspects of a user's activities.

As depicted in FIG. 1, the embodiment of the adjustable wrist band 10 includes an elongated strap 20 with a first end 22 and a second end 24 separated from the first end 22. In the depicted embodiment, the personal management device 4 is threadably received by the elongated strap 20 which generally extend continuously from the first end 22 to the second end 24. As depicted, the elongated strap 20 is threaded through a first elongated slot 6*a* and a second elongated slot 6*b*. An optional visual aperture 26 is positioned along the elongated strap 20 for positioning between the first elongated slot 6*a* and the second elongated slot 6*b* for optional illumination by the personal management device 4.

As further illustrated in FIG. 1, the first end 22 presents a pair of cylindrical receivers 28 for circumferential engagement of a centrally extending axle 33 which is positioned along one end of an elongated slot 32 extending from one end of a rotary closure 30.

The embodiment of the rotary closure 30 depicted in FIGS. 2-5B includes a generally rectangular housing 40 which provides a lateral and a longitudinal spacer 12, 14 which in communication with the hook fastener 44 allow for adjustment of the adjustable wrist band 10 during operation of the rotary closure 30. The rectangular housing 40 is secured to the strap 20 with a tab 42 and hook fastener 44, which is also referred to herein as a fastener. The tab 42 extends from the top 31*a* of the housing 40 and the fastener 44 extends from the bottom 31*b* of the housing 40.

In operation, rotation of a rotary gear 46 allows for movement of the tab 42 and fastener 44 for engagement of the elongated strap 20. As the rotary gear 46 is rotated, the tab 42 and fastener 44 extend or retract from the housing 40 which allows for contraction or expansion of the wrist strap 20. In this way, the personal management device 4 may be adjustably secured, for example, to a wearer's limb (not shown) as desired.

The tab 42 generally extends from the housing 40 and presents the elongated slot 32 with the centrally extending axle 33 extending along one end of the elongated slot 32. In one embodiment, the removable centrally extending axle 33 is configured for extending through the circular receivers 28 and for being removed as desired for securing one end of the elongated strap 20 to the housing 40. The depicted embodiment of the tab 42 is further illustrated in FIG. 4.

The fastener 44 illustrated in FIG. 1, is depicted as a downwardly angled structure for removable receipt by at least one eyelet 27 which is depicted in FIG. 1 as being positioned along the elongated band 20. Generally, the eyelet 27 includes an aperture for receiving one end of the fastener 44, the other end secured to the rotary closure 30.

Figure 2:
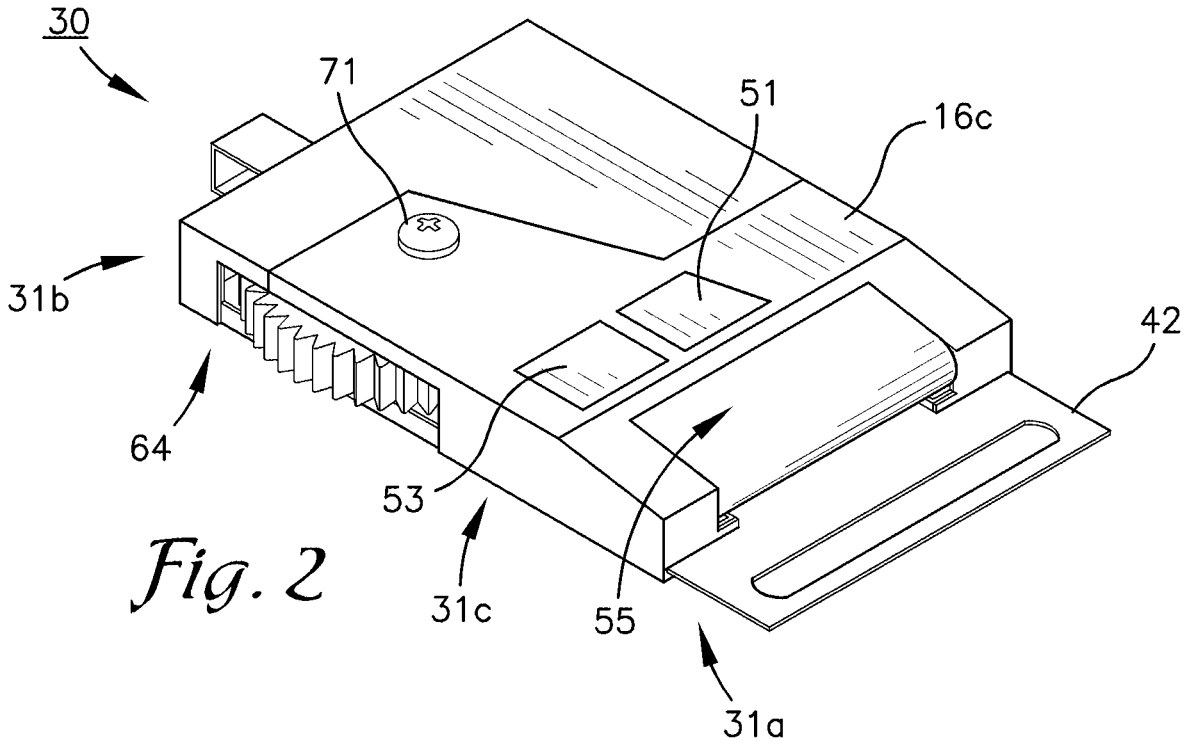
FIG. 2 is a top-side perspective view of an embodiment of the rotary adjustable wrist band in accordance with the embodiment depicted in FIG. 1.
Figure 3:
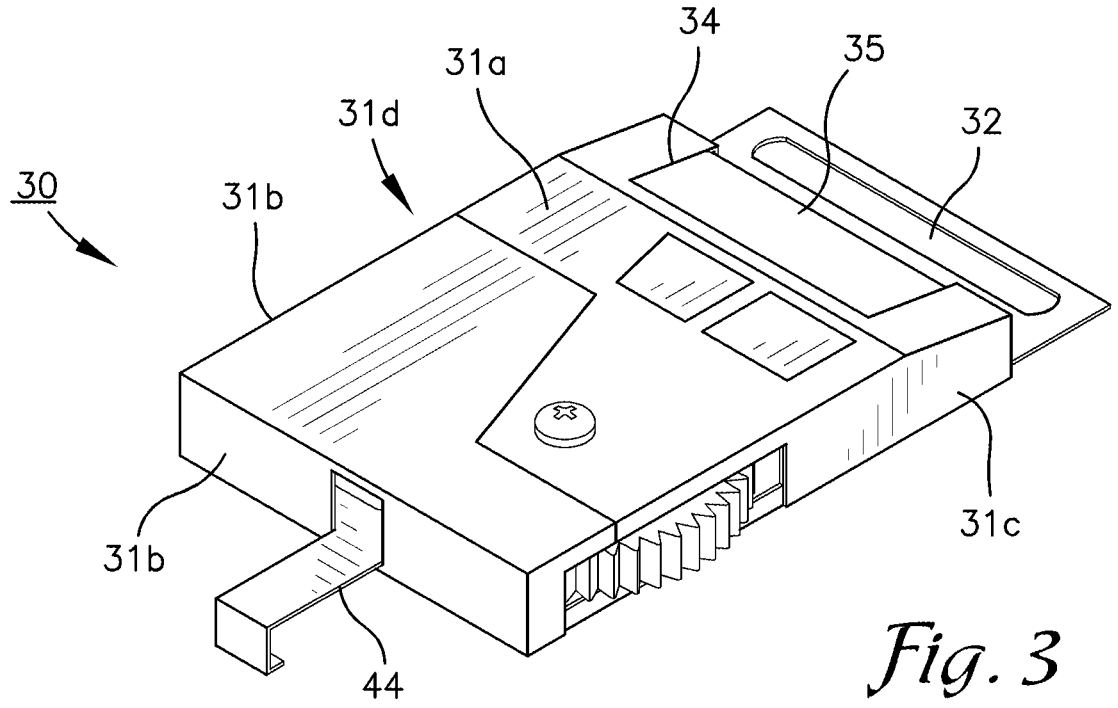
FIG. 3 is a right-side perspective view of the rotary adjustable wrist band in accordance with the embodiment depicted in FIG. 1.

As illustrated in FIGS. 2-3, the rotary closure 30 extends from a top 31*a* to a bottom 31*b* and between a first side 31*c* and a second side 31*d*. The top 31*a* is generally associated with tab 42. As illustrated in FIGS. 2-3, one embodiment of the tab 42 includes an elongated channel 32 which is configured for receipt of the first end 22 of the elongated strap 20.

The bottom 31*b* is generally associated with the fastener 44 which is configured for receipt along an opposite region of the elongated strap 20. In the embodiment of the rotary adjustable wrist band 10 depicted in FIGS. 2-3, the gear 46 extends through one of the first and second sides 31*c*, 31*b*. Incremental adjustment of the fastener 44 is accomplished by rotating the gear 46 in a clockwise or counter clockwise for tightening or loosening the elongated strap 20 as desired.

The housing 40 depicted in FIGS. 1-4 includes a plurality of operators, including a first operator 51 and a second operator 53. Generally, the first and second operators 51, 53 include a biasing mechanism 52 to maintain the first and second operator 51, 53 in an outwardly extending orientation. The embodiment of the biasing mechanism 52 illustrated in FIG. 4 includes a spring mounted between the supra clasp 56 and the first and second operators 51, 53.

Depressed activation of the first operator 51 allows for movement of the housing 40 from a closed orientation to an open orientation by engaging a housing releasing mechanism 55 and the latching mechanism 67. Depressed activation of the second operator 53 allows for movement of the fastener 44 in relation to the housing 40 by rotating the gear 46.

Figure 4:
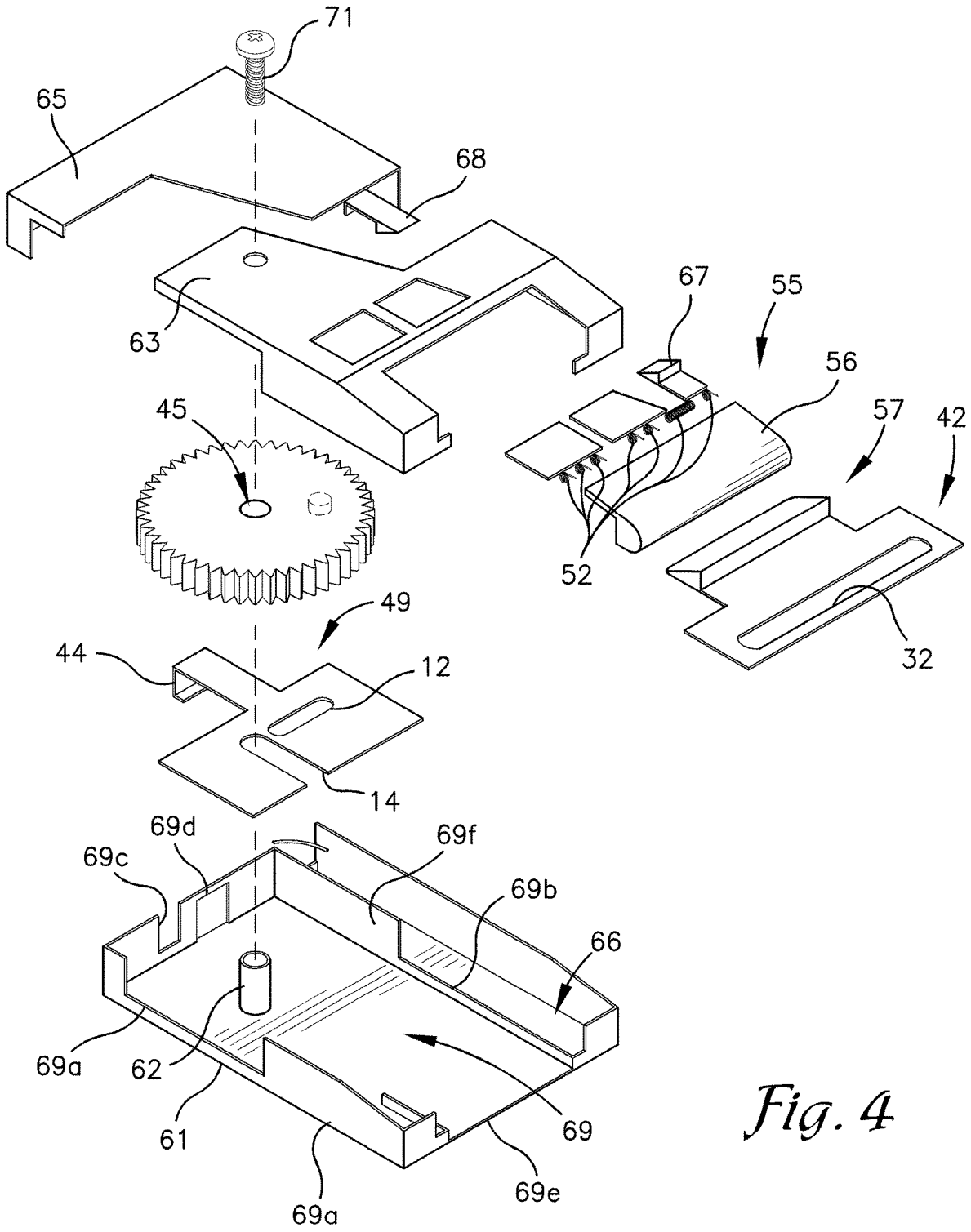
FIG. 4 is an exploded top view of an embodiment of the rotary adjustable wrist band in accordance with the embodiment depicted in FIG. 2.

The embodiment of the housing 40 illustrated in FIG. 4 includes a bottom panel 61 configured for receipt by a divisible top which includes an upper top section 63 and a lower top section 65 which are longitudinally expandable during rotation of the gear 46. The upper top section 63 presents the upper window 34 for presentation of the housing release mechanism 55. The bottom panel 61 presents a first side passage 69*a* configured for outward extension of the gear 46. The bottom panel 61 also presents an elongated channel 66 configured for receipt and longitudinal movement of the latching mechanism 67 and the catching mechanism 68.

The housing releasing mechanism 55 is accessible through an upper window 34 associated with the housing 40 which provides access to the housing releasing mechanism 55. The housing releasing mechanism 55 is in mechanical communication with the first operator 51. Operation of the first operator 51 permits the housing 40 to move between an open and a closed orientation. The housing releasing mechanism 55 generally includes a supra clasp 56 and an infra clasp 57 with complementary structures for engagement.

As depicted in FIG. 4, the supra clasp 56 includes a generally convex surface with a generally planar surface, for engagement by a generally planar surface associated with the infra clasp 57. The depicted convex surface associated with the supra clasp 56 is configured to overlie the infra clasp 57. The infra clasp 57 is illustrated in FIG. 4 as a generally triangular projection with a generally planar surface which extends outwardly from the tab 42 for engagement with the supra clasp 56.

In operation, engagement of the first operator 51 disengages the housing releasing mechanism 55 by separating the supra clasp 56 from the infra clasp 57. As the first operator 51 is pressed downward, one end of the supra clasp 56 is rotated downward, causing the opposite end to rotate in the opposite direction, separating one end of the supra clasp 56 from the infra clasp 57. Upon separation of the supra clasp 56 from the infra clasp 57, the tab 42 can extend from the housing 40.

In operation, engagement of the first operator 51, depresses one end of the supra clasp 56 in a generally downward orientation. Downward rotation of one end of the supra clasp 56 rotates the opposite end of the supra clasp 56 upwardly, in the opposite direction. Upward rotation of one end of the supra clasp 56 from the infra clasp 57, releases the tab 42 from the housing 40.

The housing 40 generally includes a bottom panel 61 with a cylindrical support 62 which is configured for threaded receipt of a threaded fastener 71. The threaded fastener 71 extends through the housing 40 and into the cylindrical support for securing the housing 40 during operation. The cylindrical support 62 is configured for receipt of the gear 46 with an outside diameter which is compatible for receipt by the inner diameter associated with the central aperture 45. The cylindrical support 62 facilitates rotation of the gear 46.

Figure 5B:
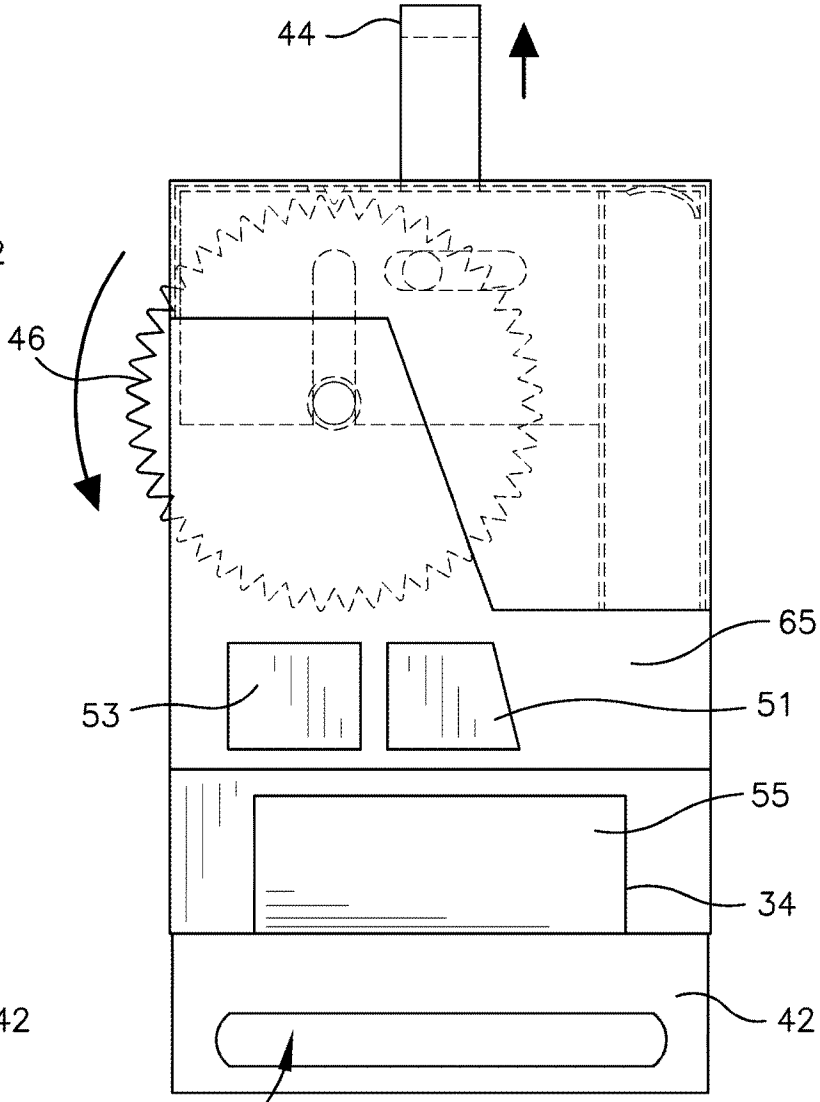
FIG. 5B is a top plane view of the embodiment of the rotary adjustable wrist band in the extended orientation in accordance with the embodiment depicted in FIG. 2, the adjustment mechanism being depicted in phantom line.
Figure 5A:
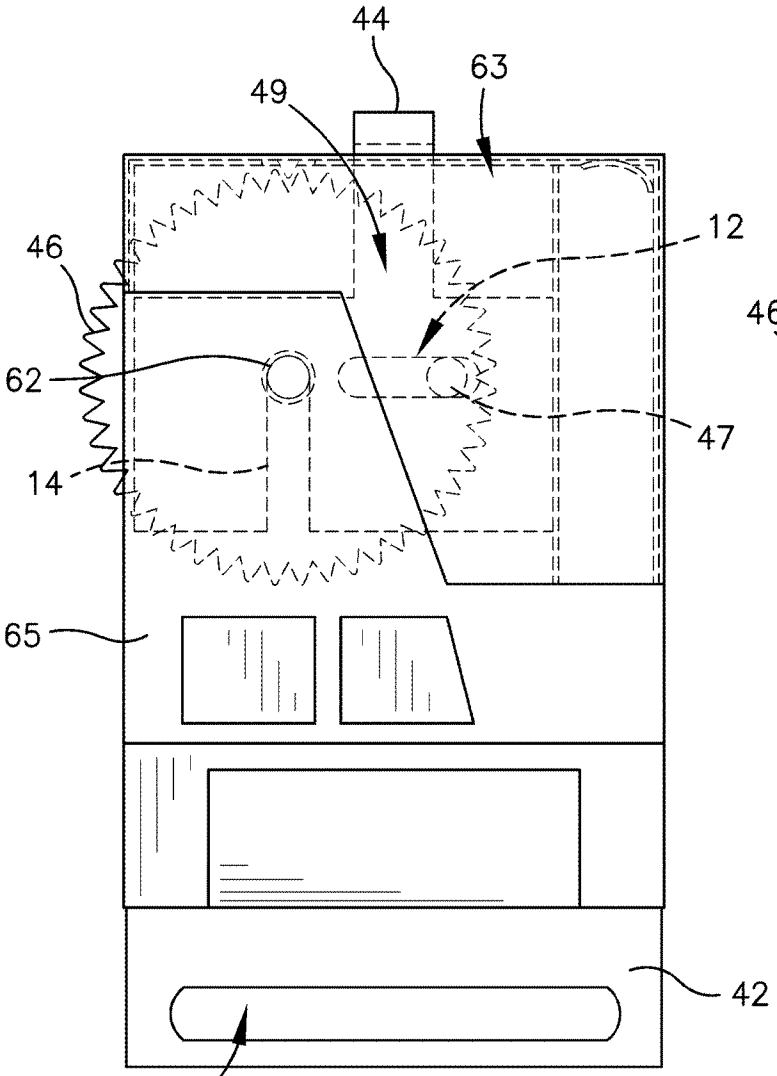
FIG. 5A is a top plane view of the embodiment of the rotary adjustable wrist band in the retracted orientation in accordance with the embodiment depicted in FIG. 2, the adjustment mechanism being depicted in phantom line.

The rotary gear 46 extends through the housing 40, providing for rotational operation of the rotary closure 30. Generally, the lateral and longitudinal spacers 12, 14 are elongated channels positioned within a guide 49 which moves in relation to the movement of the rotary gear 46. As depicted in FIG. 4, the lateral spacer 12 is generally in communication with the rotary gear 46. As the rotary gear 46 rotates, the downward detent 47 extends radially along the lateral spacer 12. As depicted in FIG. 4, the downward detent 47 is offset radially from a central axis (not shown) which extends through a central aperture 45 in the rotary gear 46. The longitudinal spacer 14 is centrally positioned along the guide 49 around the rotary gear 46. As depicted in FIG. 4, the longitudinal spacer 14 is configured for receiving the cylindrical support 62. The downward detent 47 is configured for lateral movement within the lateral spacer 12. The longitudinal spacer 14 is configured for longitudinal movement about the cylindrical support 62. As the gear 46 rotates, the guide 49 allows for longitudinal movement and lateral movement, operating the fastener 44 away from the rotary closure is indicated in FIG. 5A or towards the rotary closure 30 as indicated in FIG. 5B.

As illustrated in FIG. 4, the bottom panel 61 presents the cylindrical support 62 and a central receiving structure 69 presenting a first side passage 69*a*, a second side passage 69*b*, a pair of lower passages 69*c*, 69*d* and an upper passage 69*e*. The bottom panel 61 is configured for reciprocal longitudinal movement of the guide 49 about the cylindrical support 62. In addition, the cylindrical support 62 receives the rotary gear 46 which extends though the first side passage 69*a* as it is received by the cylindrical support 62. At least one of the pair of lower passages 69*c* and 69*d* provide passage for extension of the fastener 44. The upper passage 69*e* is configured for slidable receipt of the tab 42.

The elongated channel 66 is separated from the central receiving structure 69 along a partition 69*f* with the latching mechanism 67 extending through the second side passage 69*b* into the elongated channel 66. The elongated channel 66 is configured for receipt of the catching mechanism 68 and the latching mechanism 67. The latching mechanism 67 and catching mechanism 68 form an engagement assembly which releasably secures the divisible upper top panel 63 to the lower top panel 65. The divisible upper top panel 63 can be separated from the lower top panel 65 by activation of the first operator 51, in communication with the latching mechanism 67, separating the latching mechanism 67 from the catching mechanism 68.

The elongated spacers 12, 14 associated with the guide 49, are positioned along opposite axes which provide for reciprocal inward movement of the guide 49 as the gear 46 rotates in a clockwise or counterclockwise direction. By way of example, as the gear 46 rotates in a clockwise direction, the downward detent 47 moves up, towards the tab 42, sliding the guide 49 upward until stopped by the cylindrical support 62 along the closed end of the longitudinal spacer 14. Once the guide 49 comes to a stop, the fastener 44 is closest to the rotary closure 30 as illustrated in FIG. 5A. As the gear 46 rotates in a counter-clockwise direction, the downward detent 47 moves down, along the lateral spacer 12 and the guide 49 slides down. As illustrated in FIG. 5B, downward movement of the guide 49 extends the fastener 44 away from the rotary closure 30.

It should be understood that while certain forms of this invention have been illustrated and described, it is not limited thereto except insofar as such limitations are included in the following claims.

What is claimed and desired to be secured by Letters Patent:

1. A rotary adjustable watch band comprising:

a rectangular housing with a rotary gear extending therethrough;

a push button release mechanism comprising a tab and a fastener;

said tab extending upwardly from said housing;

said fastener extending downwardly from said housing;

said housing further comprises a first operator configured for releasing said tab from said housing; and said fastener being in communication with said rotary gear whereby rotation of said rotary gear incrementally spaces said fastener from said housing.

2. The rotary adjustable watch band of claim 1 wherein said housing further comprises a bottom panel with a first side passage configured for extension of said rotary gear therethrough.

3. The rotary adjustable watch band of claim 1 further comprising a bottom panel having a threaded cylindrical support for securing said bottom panel.

4. The rotary adjustable watch band of claim 1 further comprising a guide retained by said rectangular housing.

5. The rotary adjustable watch band of claim 1 wherein said fastener is a hook shaped fastener with a depending leg configured for receipt by an aperture within a strap extending from said tab.

6. The rotary adjustable watch band of claim 1 wherein said tab is released from said housing upon depression of said push button release mechanism.

7. The rotary adjustable watch band of claim 6 wherein said push button release mechanism further includes a supra clasp configured for engagement by an infra clasp associated with said tab.

* * * * *